US005445543A

United States Patent [19]

Williams

[11] Patent Number: 5,445,543

[45] Date of Patent: Aug. 29, 1995

[54] SLIP LUG ADAPTOR APPARATUS

[76] Inventor: Paul R. Williams, P.O. Box 15201, Hattiesburg, Miss. 39404-5201

[21] Appl. No.: 380,648

[22] Filed: Jan. 30, 1995

[51] Int. Cl.[6] ..... H01R 4/30

[52] U.S. Cl. ..... 439/727; 439/806

[58] Field of Search ..... 439/682, 685, 686, 725, 439/727, 728, 801, 806, 807, 765, 769, 770, 851, 854, 877, 879

[56] References Cited

U.S. PATENT DOCUMENTS

| | | | |
|---|---|---|---|
| 3,290,641 | 12/1966 | Payne et al. | 439/807 |
| 3,464,055 | 8/1969 | Lescarboura | 439/807 |
| 3,740,702 | 6/1973 | Moray | 439/807 |
| 4,511,204 | 4/1985 | Glenn . | |
| 4,743,204 | 5/1988 | Fromm et al. | 439/265 |
| 4,795,377 | 1/1989 | Schmode et al. | 439/728 |
| 4,799,900 | 1/1989 | Capp et al. | 439/881 |
| 5,013,268 | 5/1991 | Kunz | 439/807 |

*Primary Examiner*—Khiem Nguyen

*Attorney, Agent, or Firm*—Pravel, Hewitt, Kimball & Krieger

[57] ABSTRACT

A terminal lug adaptor for positioning on a compressor terminal, of the type wherein the terminal spade has been removed, which includes positioning a new terminal sleeve around the compressor terminal; placing a housing over the terminal sleeve, the housing further comprising a slip lug so that as the lug is rotated, the lug forces a movable divider against the sleeve so that the sleeve is permanently tightened around the terminal.

10 Claims, 2 Drawing Sheets

SLIP LUG ADAPTOR APPARATUS

BACKGROUND OF THE INVENTION

1. Field of the Invention

The present invention relates to terminal lugs. More particularly, the present invention relates to an adaptor which is adaptable to a terminal lug which has undergone corrosion, so that the lug can be utilized with the adaptor, in order to avoid replacing the compressor or motor.

2. General Background

In compressor terminals or other types of terminal connections, the terminal connection is made up of a series of lugs, which have a body portion and an upper spade portion for accommodating the plug member onto the terminal lug. One of the more common problems of terminal lugs, is the fact that the spade portion may become corroded or worn away, and therefore the lug itself, is for the most part, unusable. Since the lug cannot easily be replaced or inexpensively be replaced, the entire compressor or motor must be replaced. This type of replacement is quite expensive, and in effect, requires the replacement of other terminal lugs which are quite usable but since they are a part of the entire compressor or motor, they also must be replaced.

In order to rectify this situation, it would be convenient and a cost saving, if one had the capability of replacing or readapting the corroded terminal lug, to render it reusable rather than have to replace the entire compressor or motor. There have been patents issued in the art which address connections or the like on terminals or circuit breaker lugs, and these patents have been cited in the accompanying prior art statement. However, applicant feels that these patents do not address the problem as it is addressed with the present invention.

SUMMARY OF THE PRESENT INVENTION

The apparatus of the present invention solves the problems in the art in a simple and straight forward manner. What is provided is a terminal lug adaptor for positioning on a compressor terminal, of the type wherein the terminal spade has been removed, which includes positioning a new terminal sleeve around the compressor terminal; placing a housing over the terminal sleeve, the housing further comprising a slip lug so that as the lug is rotated, the lug forces a movable divider against the sleeve so that the sleeve is permanently tightened around the terminal.

Therefore, it is a principal object of the present invention to provide a terminal lug adaptor which provides for the positioning of a new spade member and sleeve around the terminal in a permanent fashion rather than having to replace the entire compressor or motor itself;

It is the further object of the present invention to provide an apparatus for positioning on a terminal where the terminal spade has been removed, so that a sleeve on the adaptor may be crimped around the terminal to maintain itself as a permanent connection;

It is a further object of the present invention to provide a slip lug adaptor slidable over a terminal, so that a sleeve member which comprises a new spade is positioned on the terminal, the slip lug is rotated to crimp the sleeve around the terminal for permanent replacement of the spade of the terminal.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
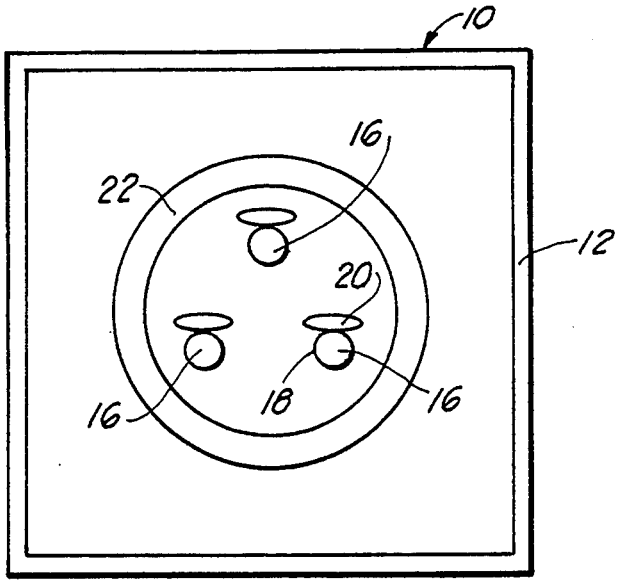
FIG. 1 illustrates a front view of a standard terminal wherein the present invention would be utilized.

FIG. 2–5 illustrate the preferred embodiment of the apparatus of the present invention, with FIG. 1 illustrating a standard view of a terminal of the type used with the present invention. As illustrated in FIG. 1, there is illustrated a terminal apparatus 10 of the type having a terminal box 12, including a plurality of terminals 16. In the preferred embodiment at least three terminals 16 would have an elongated terminal body 18 and an upper terminal spade portion 20. The three terminals 16 would be housed within a circular collar housing 22 as illustrated. This type of plurality of terminals 16 would be of the type used to engage the lines from a compressor which would be slidably engaged upon the terminal engaging both the terminal body 18 and the terminal spade portion 20.

Figure 2:
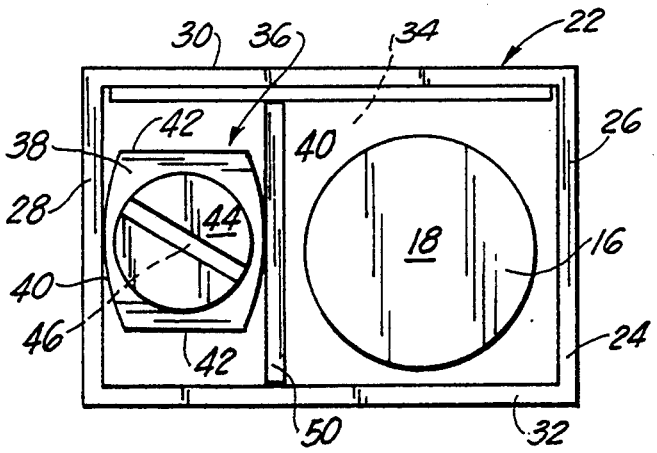
FIG. 2 illustrates the positioning of the slip lug adaptor around the terminal prior to the positioning of the terminal sleeve and spade there around.

In the use of these terminals over time, the spade portion 20 is substantially corroded and in the present state of the art, once it is corroded, it is required that the entire compressor or motor, upon which terminal 16 is mounted, has to be replaced. That being the case, FIGS. 2–5 illustrate the use of the present invention in solving this problem in a less expensive manner. What is provided is that in the event a particular terminal 16 has gotten to the point that the spade 20 has been corroded, the first step in the process is to remove all of the terminal spade 20 that remains on the compressor terminal 16, with the corroded spade 20 preferably cleaned with a file or sand cloth. As seen in FIG. 2, the terminal body 18 has been cleaned of its spade portion 20, and is simply an elongated terminal body 18 without the spade portion 20. Following the preparation of the compressor terminal 16, the apparatus 10 of the present invention is utilized. The apparatus 10 would include the slip lug adaptor portion 22 engaged around the terminal 16. The slip lug adaptor 22 comprises a rectangular box portion 24 having a pair of side walls 26, 28, an upper wall 30 and a floor portion 32, all of which together define a hollow interior 34, for housing the compressor terminal 16 having the corroded spade 20 thereon. The interior 34 of the slip lug adaptor 22 would further include a lug member 36, which may be what is known as a worm gear, having an offset body portion 38, a pair of curved sidewalls 40 and substantially flat sidewalls 42, as is illustrated in FIG. 2. The lug member 36 would further include a top portion 44, having a cut 46 therethrough for which the blade of a screwdriver or the like may be placed. Positioned between the lug member 36 and the terminal 16 would be a movable, vertical wall portion 50, which would be utilized when the present invention is used.

Figure 3:
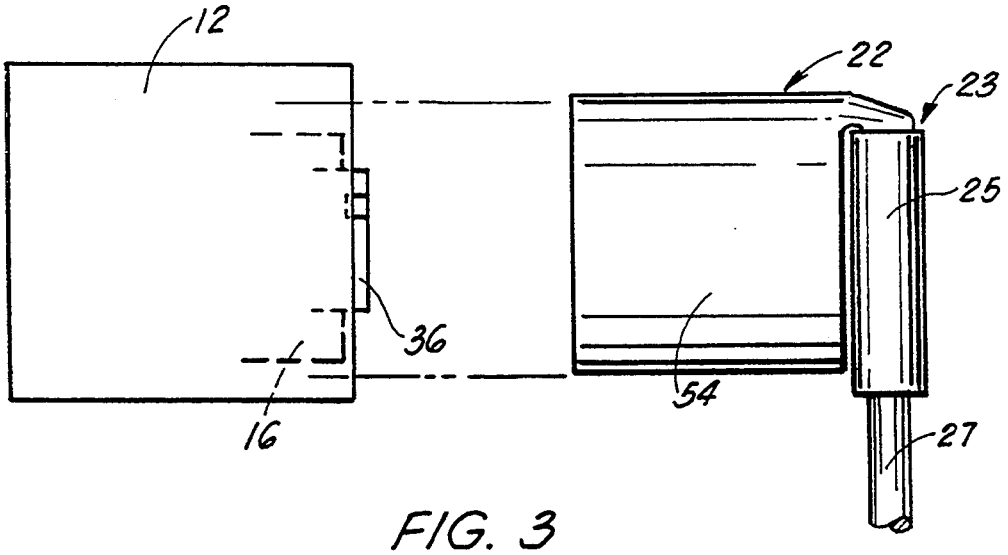
FIG. 3 illustrates a side view of the new terminal spade as it would be slid upon the terminal.
Figure 4:
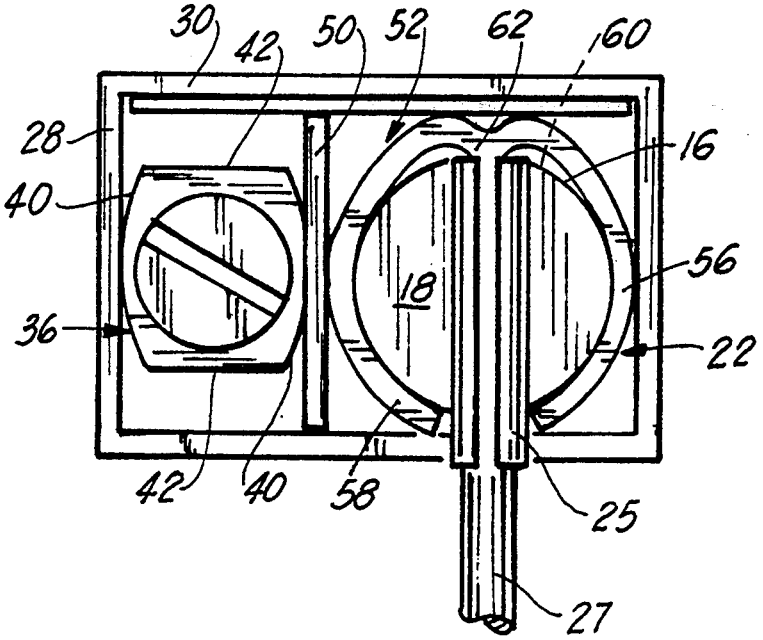
FIG. 4 illustrates an overall view of the terminal of the slip lug adaptor housing the replacement sleeve and spade around the terminal in an uncrimped position.
Figure 5:
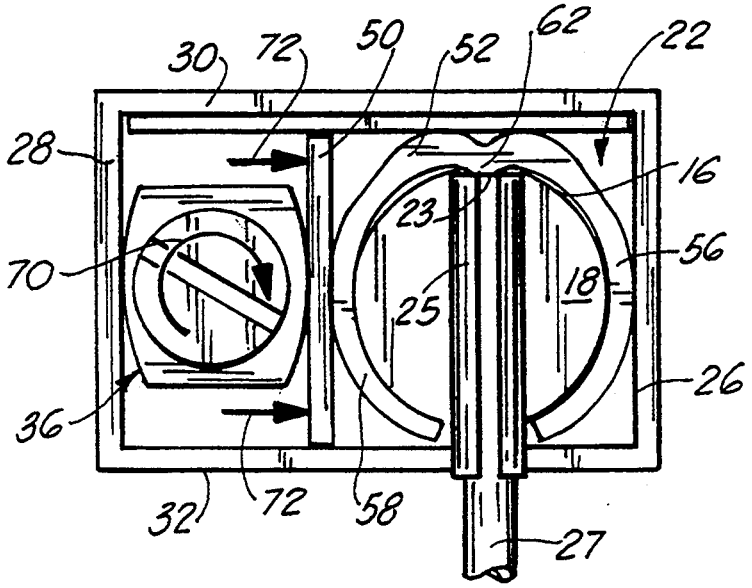
FIG. 5 illustrates a second view as illustrated in FIG. 4 whereby the sleeve would be crimped around the terminal as the lug is tightened.

As seen in FIGS. 3 through 5, the terminal 16 would then be adapted with the terminal slip lug adaptor 22, as illustrated in FIG. 3. The terminal lug adaptor 22 would comprise a substantially circular sleeve portion 52, having an upper spade portion 54, and a pair of circular side walls 56, 58. The sleeve 52 would define an opening 60 into which the terminal body 18 could be easily engaged thereinto. The sleeve portion would include an upper spade connector 62, engaged thereupon, for engaging the upper surface of the terminal lead 16, as will be explained further. Further, the terminal lug adaptor 22 would include a receiving portion 23, which would comprise an elongated member 25 engaged to the upper spade portion 54 of lug adaptor 22 for slidably receiving and engaging a lead wire 27 therein, and would serve to receive the lead wire 27 for carrying electrical current to the terminal 16 after the apparatus is in place.

In the process of engaging the terminal lead 16, as seen in FIG. 3, after the lug adaptor member 22 has been positioned around the terminal, as seen in FIG. 2, the sleeve 52, having the spade connector portion 62, is then slidably engaged onto the terminal body 18 of terminal 16, as illustrated in FIG. 3, until it is set in place. Once the sleeve 52 has been engaged around the terminal 16, and is in position, as seen in FIG. 4, the lug member 36 is in the opened position and the movable, vertical wall 50 is making contact with the sleeve 52 of the lug adaptor member 22. Following this process, the lug member 36 is then rotated (with the use of a screwdriver or the like) in the direction of arrow 70, and the vertical side wall 50 is then forced into contact with the sleeve portion 52 of the lug adaptor member 22 (arrow 72). Upon further rotation of the lug member 36, the vertical wall 50 forces the side walls 56, 58 of sleeve 52 to crimp and tighten around the terminal body 18, and the upper spade portion 62 to bite into the upper surface of the terminal 16. Once the lug member 36 is completely rotated until the tightening is complete, there is then a permanent mating between the terminal 16 and the sleeve 52 of the lug adaptor 22, to establish a new connection.

Following this procedure, the lug adaptor 22 is maintained positioned onto the terminal 16 so that the sleeve maintains itself in the permanent crimped position as seen in FIG. 5.

The following table lists the part numbers and part descriptions as used herein and in the drawings attached hereto.

PARTS LIST

| Description | Part No. |
|---|---|
| terminal apparatus | 10 |
| terminal box | 12 |
| terminal | 16 |
| terminal body | 18 |
| spade portion | 20 |
| collar housing | 22 |
| receiving portion | 23 |
| box portion | 24 |
| elongated member | 25 |
| side walls | 26, 28 |
| lead wire | 27 |
| upper wall | 30 |
| floor portion | 32 |

-continued

PARTS LIST

| Description | Part No. |
|---|---|
| hollow interior | 34 |
| lug member | 36 |
| body portion | 38 |
| curved side walls | 40 |
| flat side walls | 42 |
| top portion | 44 |
| cut | 46 |
| vertical wall portion | 50 |
| sleeve portion | 52 |
| upper spade portion | 54 |
| circular side walls | 56, 58 |
| opening | 60 |
| upper spade connector | 62 |
| arrow | 70 |
| arrow | 72 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A terminal lug adaptor positionable on a corroded compressor terminal, comprising:

a) a lug adaptor housing positionable around the corroded terminal and defining an opening between the terminal wall and a wall of the lug adaptor housing;

b) a connector member, further comprising a sleeve slidable over the terminal, the sleeve also including a spade connector portion thereon;

c) a rotatable lug member, positioned within a portion of the lug adaptor housing, for engaging the sleeve positioned around the terminal from a first uncrimped position to a second crimped position around the terminal when the lug member is rotated; and d) a wall means between the lug nut and the sleeve for engaging against the sleeve and crimping the sleeve around the terminal between the wall means and the wall of the lug adaptor housing.

2. The terminal lug adaptor in claim 1, wherein the adaptor housing includes a pair of sidewalls and an upper and lower walls to define a housing space therein.

3. The terminal lug adaptor in claim 1, wherein an upper portion of the connector member defines a spade portion to replace the spade portion corroded away from the terminal body.

4. The terminal lug adaptor in claim 1, wherein the lug member comprises a worm gear positioned in the housing.

5. A terminal lug adaptor positionable on a corroded terminal, comprising:

a) a lug adaptor housing positionable around the corroded terminal and defining an opening between the terminal wall and a wall of the lug adaptor housing;

b) a connector member, further comprising a sleeve slidable over the terminal, the sleeve also including a spade connector portion thereon for positioning around the corroded terminal;

c) a moveable wall positioned in the housing, having a first wall adjacent the sleeve; and d) a rotatable lug member, positioned within the lug adaptor housing, for engaging a second face of the moveable wall, and moving the wall against the sleeve positioned around the terminal and crimping the sleeve around the terminal between the moveable wall and a sidewall of the housing, when the lug member is rotated, so that the sleeve forms a permanent attachment around the terminal.

6. The terminal lug adaptor in claim 5, wherein the adaptor housing includes a pair of sidewalls and an upper and lower walls to define a housing space therein.

7. The terminal lug adaptor in claim 5, wherein spade portion replaces the spade portion corroded away from the terminal body.

8. The terminal lug adaptor in claim 1, wherein the lug member comprises a worm gear positioned in the housing for crimping the moveable wall against the sleeve member when the worm gear is rotated.

9. The terminal lug adaptor in claim 5, wherein the adaptor is utilized for replacing corroded terminals in compressors.

10. A method of replacing a corroded terminal of the type having a spade portion, in air compressors, comprising the following steps:

a) cleaning the corroded spade portion from the body of the terminal;

b) positioning a housing around the terminal, the housing further comprising a moveable wall within the interior of the housing;

c) positioning a sleeve member around the terminal, the sleeve member further including an upper spade portion;

d) providing a worm gear adjacent one face of the moveable wall;

e) rotating the worm gear so that the gear forces the moveable wall against the sleeve member positioned around the terminal;

f) crimping the sleeve around the terminal between the moveable wall and a wall of the housing to form a permanent connection between the sleeve and the terminal.

* * * * *